US009145745B2

(12) United States Patent
Pallini, Jr. et al.

(10) Patent No.: US 9,145,745 B2
(45) Date of Patent: Sep. 29, 2015

(54) ROTATIONALLY ACTUATED COLLET STYLE TUBULAR CONNECTION

(75) Inventors: Joseph William Pallini, Jr., Tomball, TX (US); Ali Hasan, Houston, TX (US); Rockford Dee Lyle, Pinehurst, TX (US)

(73) Assignee: Vetco Gray Inc., Houston, TX (US)

( * ) Notice: Subject to any disclaimer, the term of this patent is extended or adjusted under 35 U.S.C. 154(b) by 491 days.

(21) Appl. No.: 13/242,411

(22) Filed: Sep. 23, 2011

(65) Prior Publication Data

US 2013/0076028 A1 Mar. 28, 2013

(51) Int. Cl.
*F16L 15/02* (2006.01)
*E21B 17/042* (2006.01)
*E21B 17/08* (2006.01)

(52) U.S. Cl.
CPC ..... *E21B 17/085* (2013.01)

(58) Field of Classification Search
USPC ..... 285/34, 333–334, 355, 383, 390, 913
See application file for complete search history.

(56) References Cited

U.S. PATENT DOCUMENTS 591,828 A * 10/1897 Duncan ..... 285/339
4,159,132 A * 6/1979 Hitz ..... 285/39
4,693,497 A 9/1987 Pettus et al.
5,879,030 A 3/1999 Clayson et al.
7,686,087 B2 3/2010 Pallini et al.
7,699,354 B2 * 4/2010 Beard et al. ..... 285/123.13
2007/0252387 A1 11/2007 Beard

FOREIGN PATENT DOCUMENTS

WO 2010069863 A1 6/2010

OTHER PUBLICATIONS

Search Report and Written Opinion from corresponding Great Britain Application No. 1216926.4, dated Nov. 22, 2012.

* cited by examiner

*Primary Examiner* — Aaron Dunwoody
*Assistant Examiner* — Fannie Kee
(74) *Attorney, Agent, or Firm* — Bracewell & Giuliani LLP

(57) ABSTRACT

A collet assembly connects two tubular members with a rotation of an outer sleeve. The collet assembly includes a first tubular member with a grooved outer diameter end. The end is inserted into a collet having grooved inner and outer diameter surfaces, and an outer annular sleeve is threaded onto the collet. A grooved outer diameter end of a second tubular member is inserted into the collet. The outer annular sleeve is rotated relative to the collet. The rotation causes the collet to partially disengage from the outer annular sleeve and fully engage the grooves of the ends of the first tubular member and the second tubular member, thereby securing the first tubular member to the second tubular member.

16 Claims, 13 Drawing Sheets

ROTATIONALLY ACTUATED COLLET STYLE TUBULAR CONNECTION

BACKGROUND OF THE INVENTION

1. Field of the Invention

This invention relates in general to drilling and production of oil and gas wells, and in particular to a design of a cost effective rapid makeup connector for tubular members using a threaded collapsible collet or ring.

2. Brief Description of Related Art

A drilling riser is a large diameter pipe used in offshore drilling operations to guide the drill string from the offshore platform to and from the subsea wellhead and to provide means for circulation of drilling fluid. The drill string is lowered through the drilling riser. Drilling fluid circulates down from the platform through the drill string, out through the drill bit, and returns to the platform in the space between the inner diameter of the riser and the outer diameter of the drill string. Environmental forces caused by waves, currents, and the movement of the offshore platform, as well as internal forces caused by the weight of the heavy drilling fluids, all contribute to the substantial loads applied to the drilling riser. Additionally, high pressure drilling risers, utilizing surface blowout preventers, may be exposed to full wellbore pressure. The connection between each successive joint of drilling riser must be able to withstand such loads.

The prior art makes up the riser pipe or joint connections with bolted flange type connectors or with radially oriented screws that move dogs into and out of engagement with a profile on the riser pipe. Both of these methods require manipulation with a wrench or stud tensioning device, placing personnel in close proximity to the drilling slots for prolonged periods of time, and increasing the danger level of performing the task.

Other prior art methods involve use of screw type box and pin ends that require the rotation of the riser members through multiple turns in order to torque the tubular members into a secure connection. As with the previously discussed methods, these connection types require manipulation with a wrench device, continuing to place personnel in close proximity to the drilling slots for prolonged periods of time, and increasing the danger level of performing the task. Where the riser diameters are larger, the torque requirements for providing typical separation forces for a conventional direct threaded make-up are extremely high. Still further, the time necessary to either bolt riser joints together, screw locking dogs into engagement, or screw box and pin end joints into engagement can be quite long. This can add significantly to the overall time needed to operate the rig, greatly increasing the costs of the project.

In another prior art embodiment the riser box ends are formed with pockets and locking members positioned within the pockets. The locking members have a profile that mates with a profile on a pin end of the adjacent riser. This riser assembly includes a special cam ring that is actuated by specialty equipment on the platform. The specialty equipment causes the cam to move the locking members into engagement with the profile of the pin end to secure the riser tubulars. These cam assemblies may significantly increase the cost of the platform due to the increased capital costs for the special equipment and more expensive riser members. Therefore, a riser joint that allows for a strong connection that can be rapidly made-up without placing personnel in close proximity to the drilling slots for prolonged periods of time and at a lower capitol cost would be desirable.

SUMMARY OF THE INVENTION

These and other problems are generally solved or circumvented, and technical advantages are generally achieved, by preferred embodiments of the present invention that provide a cost effective rapid make-up connector for tubular members.

In accordance with an embodiment of the present invention, a subsea riser assembly is disclosed. The assembly includes an upper tubular member having an end and an axis, and a lower tubular member having an end, the lower tubular member coaxial with the upper tubular member. The end of the upper tubular member is proximate to the end of the lower tubular member. The assembly includes a radially contractible member partially engaged with the end of at least one tubular member while in an initial position. The radially contractible member has constant diameter threads on an outer diameter of the member. The assembly also includes an outer sleeve having threads on an inner diameter that fully engage the threads on the outer diameter of the radially contractible member in the initial position, the outer sleeve threaded onto the radially contractible member. Rotation of the outer sleeve relative to the radially contractible member is a first direction causes the outer sleeve thread to move from a fully engaged position to a partially engaged position, thereby moving the radially contractible member inward to a made up position that secures the lower tubular member to the upper tubular member.

In accordance with another embodiment of the present invention, a subsea riser assembly is disclosed. The subsea riser assembly includes a first tubular member having a central bore with an axis and an end with outer diameter grooves formed on an outer diameter portion of the first tubular member end. The assembly also includes a collet landed in an initial position on an upward facing collet shoulder formed on the outer diameter of the first tubular member end, the shoulder axially below the first tubular member end outer diameter grooves. The collet has lower inner diameter collet grooves formed on an inner diameter lower portion of the collet partially engaged with the outer diameter grooves of the first tubular member in the initial position, upper inner diameter collet grooves formed on an inner diameter upper portion of the collet, and constant diameter outer diameter collet threads formed on an outer diameter portion of the collet that extend the axial length, of the collet. The collet is radially contractible from the initial position to a made-up position. The assembly also includes an outer annular sleeve having sleeve threads formed on an inner diameter surface of the outer annular sleeve, the sleeve threaded onto the outer diameter collet threads in the initial position. The assembly further includes a second tubular member having a central bore and an axis coaxial with the first tubular member central bore and axis. The second tubular member has an end with outer diameter grooves formed on an outer diameter portion of the second tubular member end. The second tubular member end is inserted into the collet so that the outer diameter grooves on the first tubular member end and the outer diameter grooves on the second tubular member end are adjacent to the lower and upper inner diameter grooves of the collet, respectively, in the initial position. A rotation of less than 360° of the outer annular sleeve relative to the collet causes the collet to move to the made-up position. The threads on the outer diameter of the collet are partially engaged with the inner diameter threads of the outer annular sleeve in the made-up position so as to retain the collet in the made-up position. The upper and lower inner diameter grooves of the collet engage the outer diameter grooves of the first and second tubular member ends, thereby securing the first tubular member to the second tubular member in the made-up position.

In accordance with yet another embodiment of the present invention, a subsea riser assembly is disclosed. The subsea riser assembly includes an upper tubular member having an end, and a lower tubular member having an end, the lower tubular member coaxial with the upper tubular member. The upper tubular member end is proximate to the lower tubular member end. The assembly includes a radially contractible collet having a downward facing shoulder on an inner diameter upper end and an upward facing shoulder on an inner diameter lower end. The upper tubular member has an upward facing shoulder on an end of the upper tubular member in contact with the downward facing shoulder on the upper end of the collet. The lower tubular member has a downward facing shoulder on an end of the lower tubular member in contact with the upward facing shoulder on the lower end of the collet. A lower portion of the collet is partially engaged with the lower tubular member in the initial position. The collet has constant diameter threads on an outer diameter of the collet. An outer sleeve has threads on an inner diameter that fully engage the threads on the outer diameter of the collet in the initial position. Rotation of the outer sleeve and collet relative to each other causes the collet to fully engage the downward facing collet shoulder with the upward facing shoulder of the upper tubular member and the upward facing collet shoulder with the downward facing shoulder of the lower tubular member. The rotation causes the outer sleeve thread to move from a fully engaged position to a partially engaged position, thereby retaining the collet in a made up position that secures the lower tubular member to the upper tubular member.

In still another embodiment, a subsea riser assembly is disclosed. The assembly includes an upper tubular member having an end, and a lower tubular member having an end with a plurality of box end fingers separated by slots, the lower tubular member coaxial with the upper tubular member. The end of the upper tubular member is inserted into the end of the lower tubular member. Grooves are formed on an outer diameter of the upper tubular member end, and grooves are formed on an inner diameter of the lower tubular member so that the grooves of the upper tubular member are proximate to the grooves of the lower tubular member when the upper tubular member is inserted into the end of the lower tubular member. A radially contractible split collet ring is partially engaged with the end of the lower tubular member while in an initial position. The split collet ring has constant diameter threads on an outer diameter of the member, and an outer sleeve has threads on an inner diameter that fully engage the threads on the outer diameter of the split collet ring in the initial position. Rotation of the outer sleeve relative to the split collet ring causes the outer sleeve thread to move from a fully engaged position to a partially engaged position, thereby causing the split collet ring to contract radially and the box end fingers to contract radially. The radial contraction of the box end fingers causes the grooves on the end of the upper tubular member to fully engage the grooves on the end of the lower tubular member, thereby securing the upper tubular member to the lower tubular member.

An advantage of a preferred embodiment is that it provides a cost effective rapid make-up connector for tubular members. The connector may be made-up without a wrench or stud tensioning device, placing personnel in close proximity to the drilling slots for shorter periods of time, and decreasing the danger level of performing the task. In addition, the connector may be made up with fewer turns, significantly decreasing the time required to make up the connection. Still further, the connector does not use a significant amount of specialty equipment to make the connection, further reducing overall costs of riser assembly. Still further, the connection uses a specially shaped thread and radially collapsible member to generate a higher radial and axial preload force than current tubular connection systems.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout.

In the following discussion, numerous specific details are set forth to provide a thorough understanding of the present invention. However, it will be obvious to those skilled in the art that the present invention may be practiced without such specific details. Additionally, for the most part, details concerning rig operation, subsea assembly connections, riser use, and the like have been omitted inasmuch as such details are not considered necessary to obtain a complete understanding of the present invention, and are considered to be within the skills of persons skilled in the relevant art.

Figure 1:
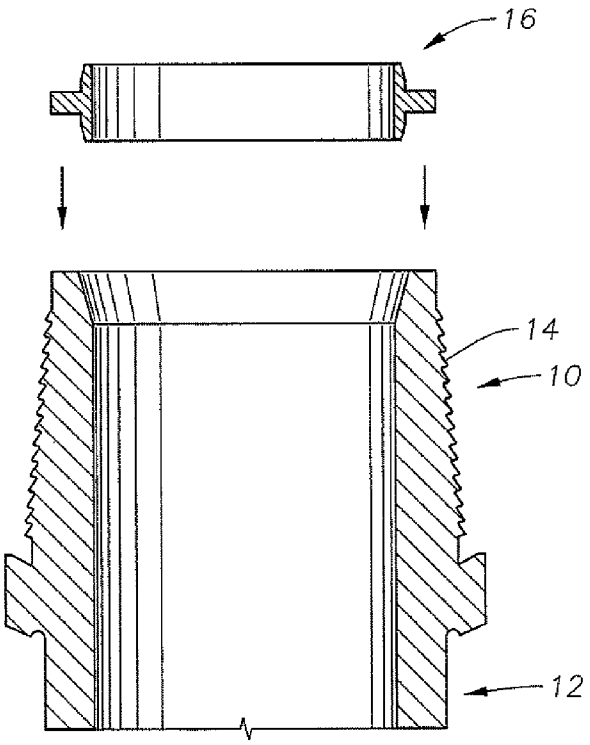
FIG. 1 is a side sectional view of a tubular being fitted with a nose seal in accordance with an embodiment of the present invention.

Described herein are example embodiments of connecting tubulars to form a string of tubulars. A step of connecting tubulars is provided in the example of FIG. 1 that illustrates a side sectional view of an example of a threaded end 10 of an annular tubular 12 and having grooves or threads 14 on the threaded end 10. In the embodiment of FIG. 1, crests (or loading flanks) on the threads 14 are shown angling downward and away from the opening of the tubular 12. A nose seal 16 is shown that as described below will land on the upper terminal end of the tubular 12.

Figure 2:
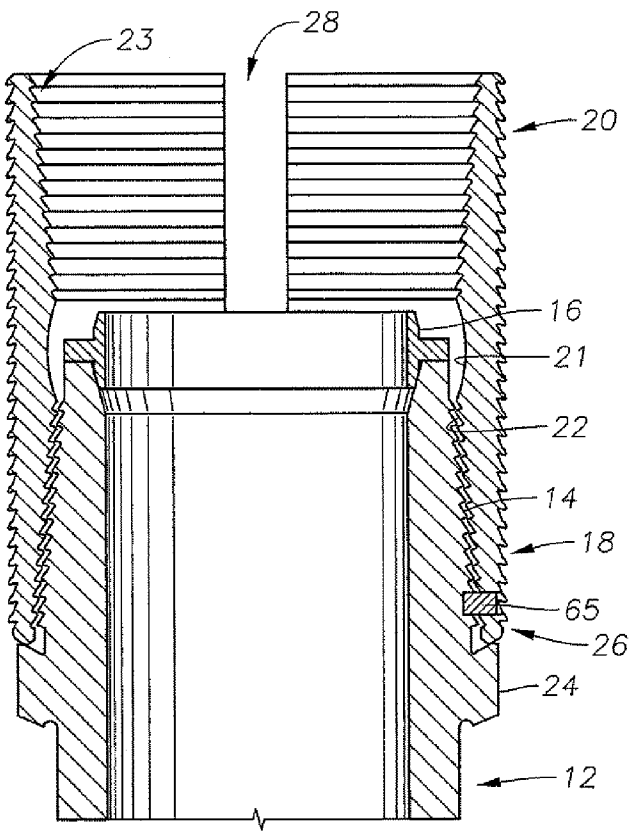
FIG. 2 is a side sectional view of the tubular of FIG. 1 being fitted with a collet in accordance with an embodiment of the present invention.

Provided in a side sectional view in FIG. 2 is another example step of connecting tubulars. In the example of FIG. 2, an annular collet member 18 is shown landed over the threaded end 10 of the tubular 12. Collet member 18 is pinned to threaded end 10 to prevent rotation of collet member 18 relative to tubular member 12 with a set screw 65. A person skilled in the art will understand that while set screw 65 limits rotation, set screw 65 will allow some axial movement of collet member 18 relative to tubular member 12 as described in more detail below. The collet member 18 includes threads 20 along a substantial portion of its outer surface. The inner surface of the collet member 18 is shown also having machined or otherwise formed circumferential profiles 23 and with a generally smooth portion 21 along its mid-portion that separates upper and lower profiled portions. Grooves or threads 22 are provided on the lower profiled portion on the inner surface of the collet member 18 that face the threads 14 on the tubular 12. In the embodiment of FIG. 2, crests on the threads 22 face generally upward and towards the smooth portion 21. While there is some interference between the threads 14, 22, it is at this point minor. The profiles 23 on the opposite side of the smooth portion 21 can be threads, grooves, or both. In an example, grooves may be distinguished from threads in that grooves are a series of generally parallel profiles on a surface rather than a single helical profile. Shown on the outer radial surface of the tubular 12 is a box shoulder 24, which is a flange-like member integrally formed on the tubular 12 and is shown being a support for the lower end 26 of the collet member 18. A slot 28 is shown axially extending through the collet member 18 for allowing elastic radial deformation of the collet member 18. In an optional embodiment, the slot 28 may have a serpentine profile.

Figure 3:
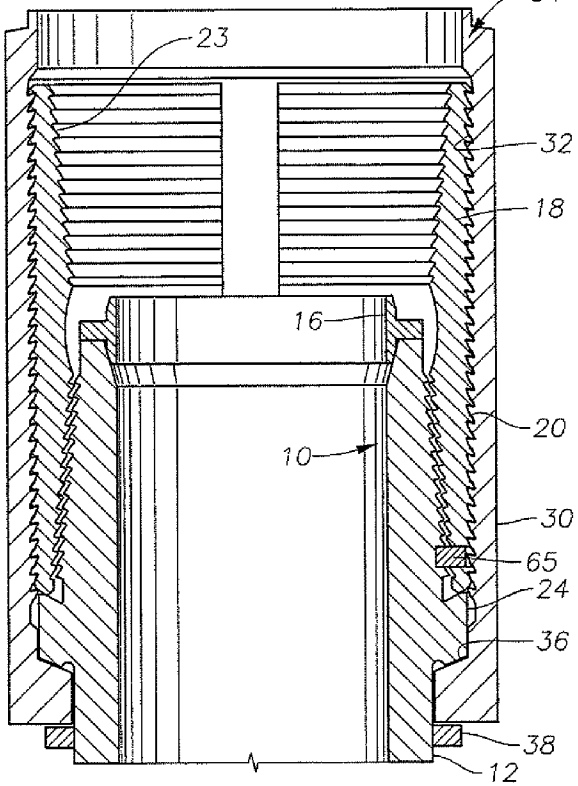
FIG. 3 is a side sectional view of an embodiment of FIG. 2 having a sleeve circumscribing the collet in accordance with an embodiment of the present invention.

Shown in FIG. 3 is another step of forming a tubular connection where an annular outer sleeve 30 is threaded onto the outer surface of the collet member 18. Threads 32 are shown formed along a portion of the inner radial surface of the outer sleeve 30 that mate with the threads 20 on the outer surface of the collet member 18 and form a threaded connection 34. In an example of use, the end of the tubular 12 opposite the threaded end 10 is inserted into the outer sleeve 30, and the outer sleeve 30 is moved axially along the tubular 12 to engage the threads 20, 32. Rotating the outer sleeve 30 then threadingly engages the outer sleeve 30 with the collet member 18 as shown. Sleeve 30 defines an upward facing shoulder 36 on a lower end of sleeve 30. Upward facing shoulder 36 contacts a downward facing shoulder of box shoulder 24. Optionally, a retainer ring 38, which can be a snap type ring, mounts onto the outer surface of the tubular 12 for supporting the outer sleeve 30 in its position. Further in the embodiment of FIG. 3, the nose seal 16 is landed on the upper terminal end of the tubular 12. The nose seal 16 has a ring-like mid-portion configured to coaxially slide within the open end of the tubular 12, and a flange extending radially outward from a mid-portion of the ring-like section. The flange has an inner and outer radius equal to or overlapping that of the terminal edge of the tubular 12. The embodiment of FIG. 3 forms a box connection that is ready to accept a mating pin.

Figure 4:
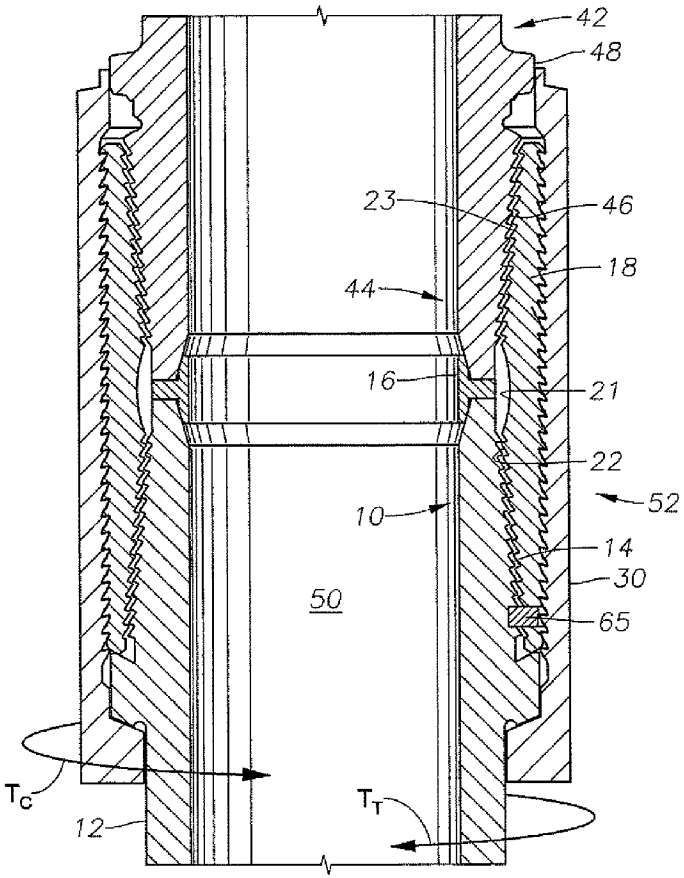
FIG. 4 is a side sectional view of a temporary end type tubular being inserted into the collet and sleeve and forming a connection assembly for the box and pin tubulars in accordance with an embodiment of the present invention.

FIG. 4 provides an inside sectional view of an example step of forming a tubular connection wherein a second tubular is introduced for connection to the originally shown tubular of FIGS. 1-3. More specifically in FIG. 4, a tubular 42 is shown having its profiled end 44 being inserted axially into an end of the collet member 18 disposed opposite the threaded end 10 of the tubular 12. Profiles 46 on the outer circumference of the profiled end 44 are shown adjacent the profiles 23 formed on the inner surface of the collet member 18 and above the smooth portion 21. An advantage may be realized in an example embodiment where profiles 23 and profiles 46 are both grooves, so the profiled end 44 can be axially inserted into the collet member 18 to engage the profiles 23, 46 without rotating either tubular 12, 42. In the embodiment of FIG. 4, there is no interference between profile 23 and profile 46. Profiles 46 are circumferential grooves in this embodiment, having the same configuration as profiles 23. FIG. 4 generally illustrates an initial position for the connection of tubular members as disclosed herein.

Also shown in FIG. 4, at an axial location above the upper terminal end of the profiles 46, the outer diameter of the tubular 42 extends out for an axial distance to define a pin shoulder 48. Additionally, the radial dimensions of the tubulars 12, 42 are substantially similar so that when joined end to end an annulus 50 is defined that extends through the hollow portion of the respective tubular 12, 42. Pin shoulder 48 is spaced above the end of collet 18. Moreover, the lower terminal end of the tubular 42 is shown landed on a side of the radial ridge portion of the nose seal 16. The ring-like portion of the nose seal 16 extends coaxially between the open ends of the tubulars 12, 42 and defines a sealing interface along the contact surface. A pressure differential between the annulus 50 and the exterior of the tubulars 12, 42 is maintained by the nose seal 16. In an optional embodiment, the collet 18 is biased radially inward so that when tubular 42 is inserted within the collet 18, the profiles 23 engage the profiles 46 in a ratchet like manner. As such, the profiles 23, 46 are partially engaged to form a coupling between the collet 18 and tubular 42 that is "hooked" but not locked.

Figure 5A:
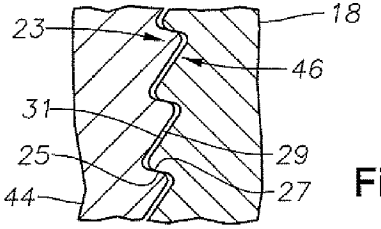
FIGS. 5A-5C are side sectional views of engagement of threads and profiles of the embodiment of FIG. 5.
Figure 5B:
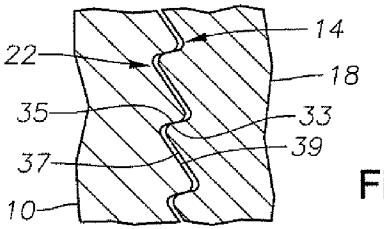

The assembly in FIG. 4 defines an unlocked threaded connection 52. More specifically, the threads 22 or profiles 23 on the inner circumference of the collet member 18 are not fully engaged with corresponding threads 14 or profiles 46 on the threaded ends 10, 44 of the tubulars 12, 42. In a step in the method of connecting tubulars as described herein, applying oppositely directed torques $T_T$, $T_C$ respectively to the tubular 12 and outer sleeve 30 changes the unlocked threaded connection 52 to a locked threaded connection 52A (FIG. 5), thereby connecting the tubulars 12, 42. As illustrated in the side sectional view in FIG. 5C, applying torques $T_T$, $T_C$ to the outer sleeve 30 and tubular 12 (FIG. 4) causes the threads 20, 32 to engage one another on their respective crests thereby urging the collet member 18 radially inward. As a result, the threads 14 and profiles 46 on the respective outer surfaces of the threaded ends 10, 44 are now in connective engaging contact with the threads 22 and profiles 23 on the inner circumference of the collet member 18. Provided respectively in FIGS. 5A and 5B are illustrations of how the loads flanks of the profiles 23, 46 and threads 14, 22 engage one another. More specifically, the lower flanks 25 of the downwardly depending profiles 23 contact the upper flanks 27 of the profiles 46. However, the obliquely oriented flanks, 29, 31 of the profiles 23, 46, respectively, may have a clearance between each other. Similarly, in the example illustrated, the lower flanks 33 of the downwardly depending threads 22 contact the upper flanks 35 of the threads 14 while the obliquely oriented flanks 37, 39 of the threads 22, 44, respectively, may have a clearance between each other.

Figure 5C:
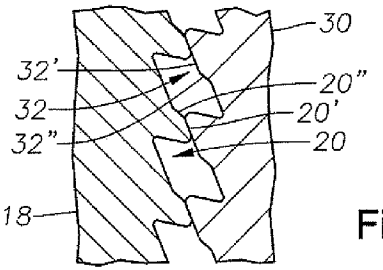
Figure 5:
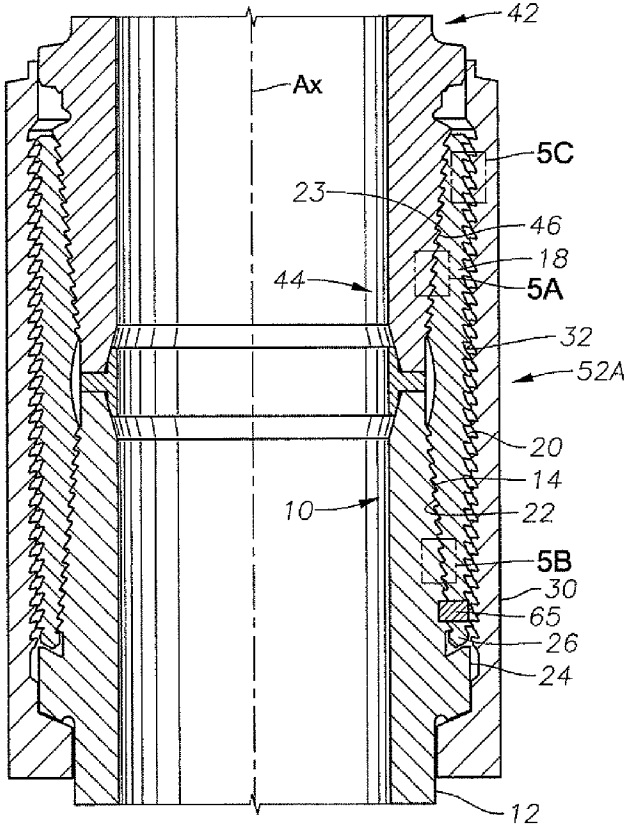
FIG. 5 is a side sectional view of the connection assembly of FIG. 4 in a connected configuration in accordance with an embodiment of the present invention.

The assembled threaded connection 52A of FIG. 5 also illustrates the lower end 26 of the collet member 18 moved up and away from the box shoulder 24. As such, the collet member 18 is pushed radially inward, thereby generating a preload onto the threaded connection 52A. Preloading the threaded connection 52A with the applied torque readies the connection for the application of tension, bending, as well as internal pressure, compression, external pressure, and any combination of these loads. The threads 14, 22 and profiles 23, 46 are shown having orientations oblique to an axis of the annulus 50. The oblique orientation to the axis of the annulus 50 will generate an axial preload force on the tubulars 12, 42.

As illustrated in FIG. 5C, tubular member 42 is fully made-up to tubular member 12. In this position, threads 20, 32 are partially engaged, such that the crests of each thread are in contact to maintain a radially inward force on collet member 18. Threads 20 have an outer shallow flank 20' at a shallow angle to an axis $A_X$ of the annulus 50 and a inner deep flank 20" at a greater angle to the axis $A_X$ of the annulus 50. Similarly, threads 32 have an inner deep flank 32" at an angle to the axis $A_X$ of the annulus 50 that is substantially similar to the angle of the inner deep flank 20" and an outer shallow flank 32' at a shallow angle to the axis $A_X$ of the annulus 50 that is substantially similar to the angle of the outer shallow flank 20'. Generally, the angle of the outer shallow flank 20' and the outer shallow flank 32' is shallower relative to the axis of the bore 50 than the angle of the inner deep flank 20" and the inner deep flank 32". The inner deep flank 20" and the inner deep flank 32" will mate when threads 20, 32 are in the initial position. Similarly, the outer shallow flank 20' and the outer shallow flank 32' will mate when threads 20, 32 are in the final position. As the sleeve 30 is rotated relative to the upper tubular member 42, the angle of the outer shallow flank 20' and the outer shallow flank 32' will allow threads 20, 32 to remain at least partially engaged so that the outer sleeve 30 may exert a radially inward force on the collet 18. When rotated, interference the inner deep flank 20" and the inner deep flank 32" initially results in collet member 18 being rapidly forced radially inward by the outer sleeve 30. As the outer shallow flank 32' engages the outer shallow flank 20', the shallow angle moves the collet member 18 at a slower pace and an increased radial force. In addition, some axial force is generated. FIG. 5 generally illustrates a made up position in the connection of tubulars as disclosed herein.

Figure 7:
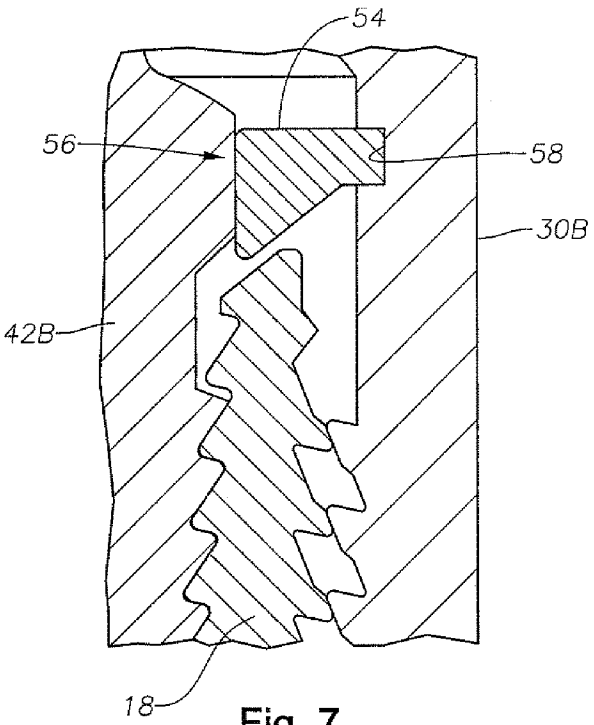
FIG. 7 is a detailed view of a portion of the embodiment of FIG. 6 in accordance with an embodiment of the present invention.
Figure 6:
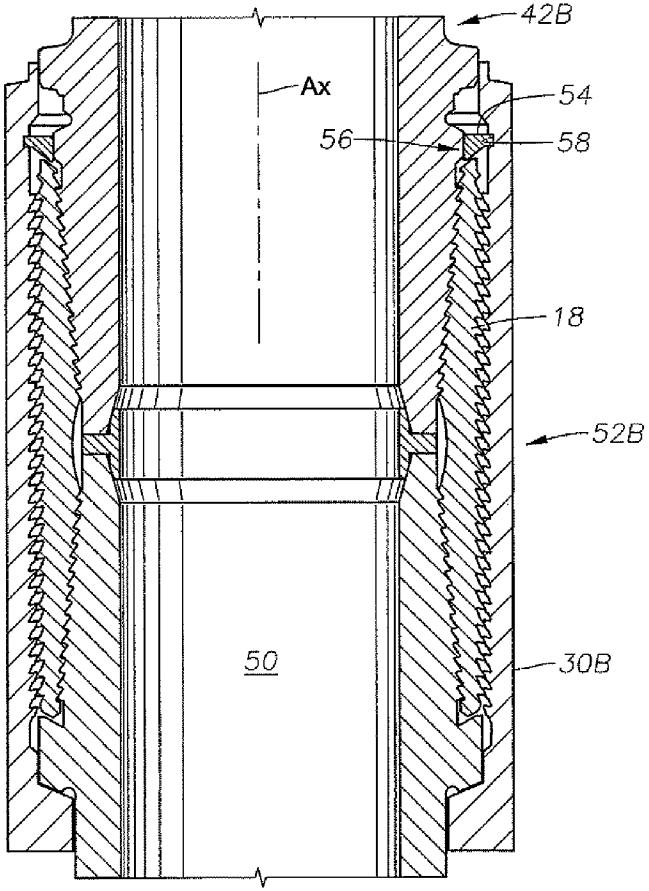
FIG. 6 is an alternate embodiment of connected tubulars having a wedge ring for unlocking the connection assembly of FIG. 5 in accordance with an embodiment of the present invention.

Referring now to FIGS. 6 and 7, an alternate embodiment of the threaded connection 52B is shown in a side sectional view. In this embodiment, a wedge ring 54 is shown disposed in an annular space that exists between the tubular 42B and the outer sleeve 30B. Shown in cross-section, the wedge ring 54 has a generally triangular shaped cross-section with an inner surface that runs generally parallel with an axis $A_X$ of the annulus 50. The inner surface of the wedge ring 54 is shown coaxially circumscribing an outwardly extending portion on the tubular 42B that defines a wedge ring seat 56. An upper or lateral surface of the wedge ring 54 extends radially outward from the tubular 42B and into a groove 58 formed on the inner surface of the outer sleeve 30B. In the embodiment of FIG. 6, the groove 58 is shown having a generally rectangular cross-section. The wedge ring 54 has a lower lateral surface shown extending from the portion within the groove 58 and angling downward towards the tubular 42B. This angled surface corresponds to an angled profile on the upper terminal end of the collet member 18. Referring now to FIG. 7, an exploded view of the respective angled surfaces of the wedge ring 54 and collet member 18 are illustrated and facing one another in the annular space between the outer sleeve 30B and tubular 42B. The configurations of FIGS. 6 and 7 depict the threaded connection 52B in a locked position. Unlocking the threaded connection 52B can be accomplished by providing a torque to the threaded connection 52B and in a direction opposite that applied to form a locked threaded connection 52A. The oppositely sloping surfaces of the lateral side of the wedge ring 54 and upper end of the collet member 18 come into contact. As the wedge 54 is moved downward, the grooves in the collet member 18 are forced to disengage from the tubular 42B, thereby moving the threaded connection into an unlocked position.

Figure 8:
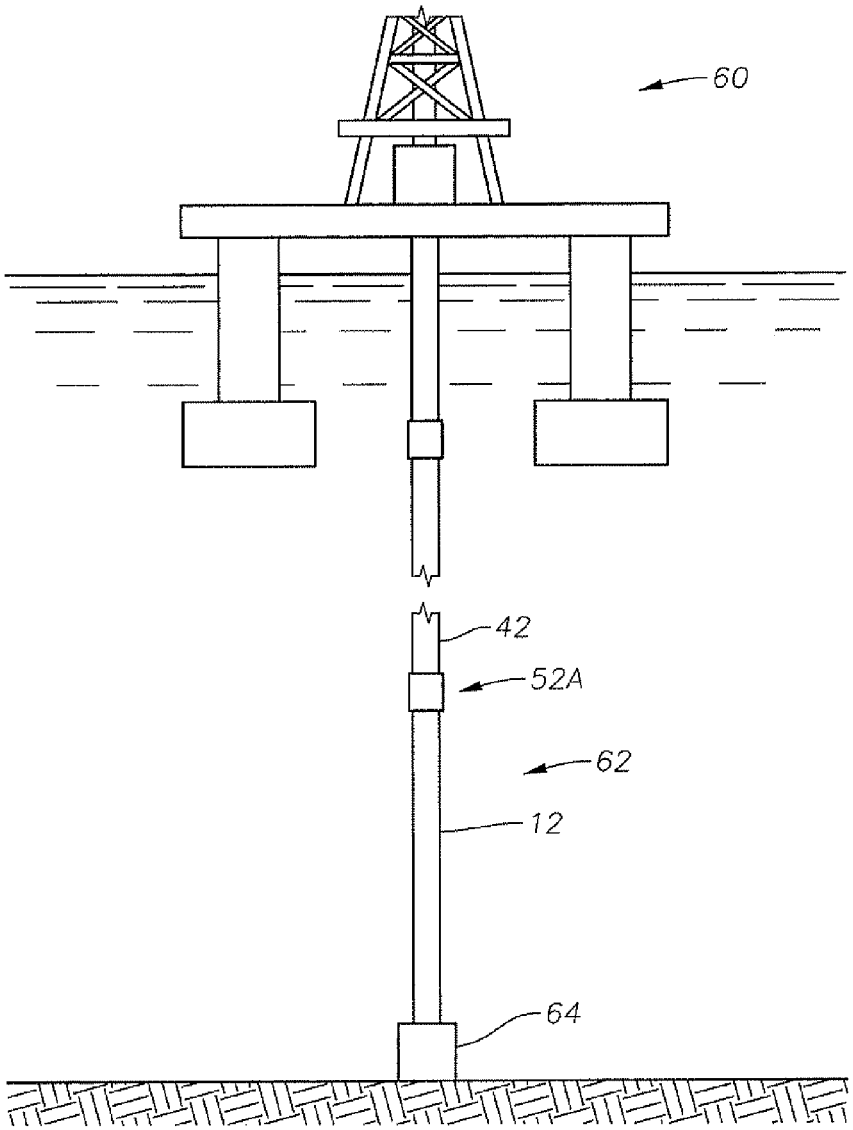
FIG. 8 is a side partial sectional view of a method of assembling a riser in accordance with an embodiment of the present invention.

Shown in a side view in FIG. 8 is one example of an offshore platform 60 having a riser 62 depending subsea for connection with a subsea wellhead assembly 64 shown on the sea floor. In the embodiment of FIG. 8, the riser 62 is being assembled by connecting tubulars 12, 42 with the aforementioned method of connecting and providing a locked connection 52A between the tubulars 12, 42. Of the many advantages of the method disclosed herein is the speed at which the riser 62 can be made by the connections 52A as well as the low torque to preload ratio.

Figure 9:
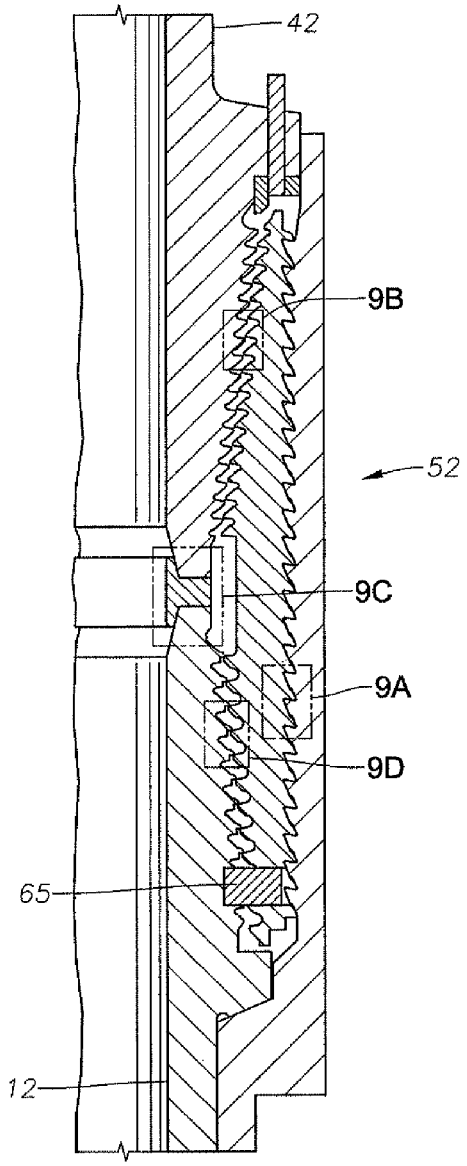
FIG. 9 is a side sectional view of alternate embodiments of a method of assembling a riser in accordance with the present invention.
Figure 9A:
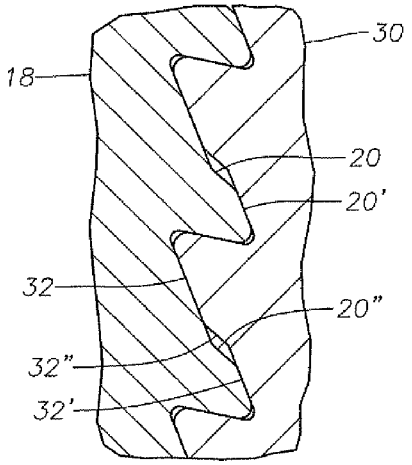
FIGS. 9A-9D are side sectional views of engagement of threads and profiles of the embodiment of FIG. 9.
Figure 9B:
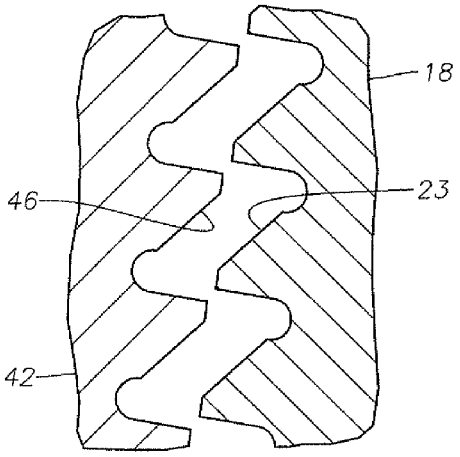
Figure 9C:
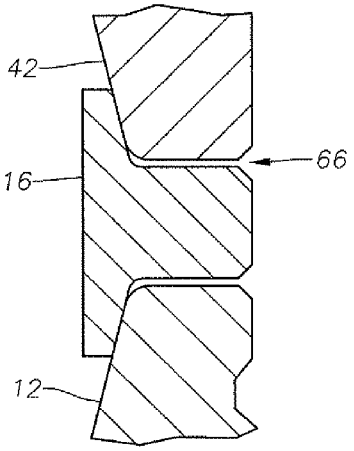
Figure 9D:
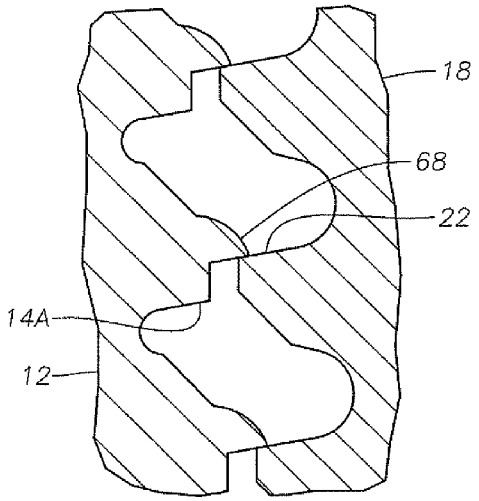

FIGS. 9 through 12 provide details of interfaces between the threads and profiles in an example embodiment of a torqueing (or make-up) procedure to form a threaded connection as described herein. Enlarged views are included in each of FIGS. 9 through 12 depicting portions of the interface between the profiles 23 of the collet 18 and profiles 46 of the tubular 42, the interface of the nose seal 16 and tubulars 12, 42, the interface between the threads 22 on the collet 18 and threads 14A on the threaded end 10, and the interface between the threads 20 on the collet 18 and threads 32 on the outer sleeve 30. Referring now to FIG. 9, illustrated is an example embodiment of the threaded connection 52 in an unlocked configuration. As shown in FIG. 9B, profiles 23 and 46 are shown spaced apart thereby allowing clearance for the tubular 42 to move axially with respect to the collet 18. Also, when in the unlocked configuration, a space 66 exists between the nose seal 16 and one or both of the terminal ends of the tubulars 12, 42, as shown in FIG. 9C. Referring to FIG. 9D, the threads 14A, shown as having a thread tip 68 with a curved surface on a surface facing towards the opposing tubular 42 and substantially planar on an opposite surface. The alternative thread form shown allows the collet 18 to ratchet relative to the tubular 12 while the tubular 42 enters the collet 18 opposite the tubular 12. Thus, threads 22 may move axially downward relative to the tubular 12, but not axially upward as the tubular 42 brought into the system for later connection. The threads 22 slightly overlap the threads 14A on the planar side of the thread tip 68. Further, as shown in FIG. 9A, the threads 20 fully engage the threads 32 thereby eliminating voids between the collet 18 and outer sleeve 30. As shown in FIG. 9A, inner deep flank 20" does not initially engage inner deep flank 32". Similarly, outer shallow flank 20' does not initially engage outer shallow flank 32'. Anti-rotation pin or set screw 65 is shown in FIG. 9 and extends radially through a passage in the collet 18 and couples to the tubular 12. Connecting the pin 65 to the tubular 12, such as by a threaded connection, can prevent the collet 18 from rotating as the outer sleeve 30 is rotated with respect to the collet 18. As described in more detail below, the pin 65 will not prevent radial contraction of the collet 18.

Figure 10:
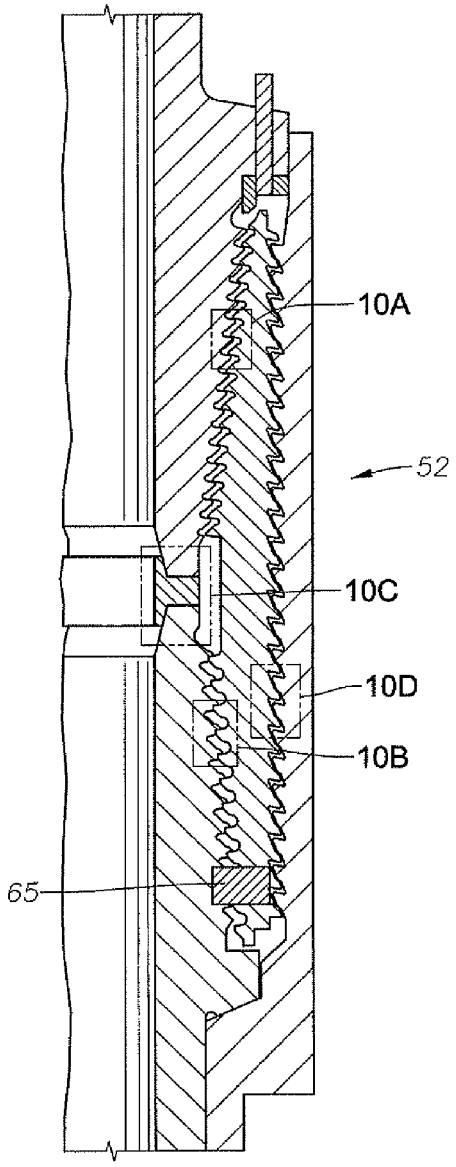
FIG. 10 is a side sectional view of alternate embodiments of a method of assembling a riser in accordance with the present invention.
Figure 10D:
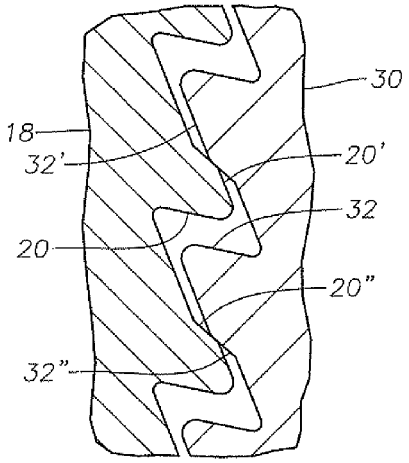
FIGS. 10A-10D are side sectional views of engagement of threads and profiles of the embodiment of FIG. 10.
Figure 10A:
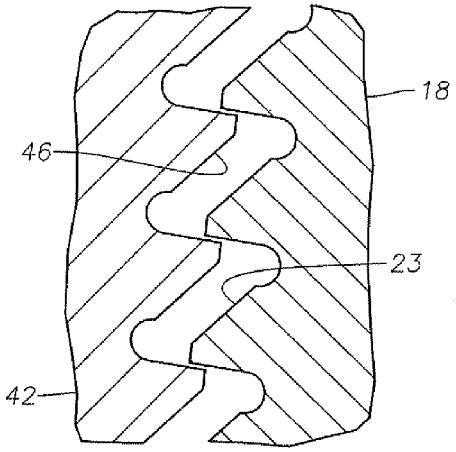
Figure 10C:
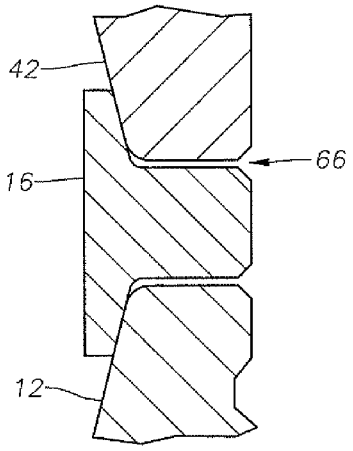
Figure 10B:
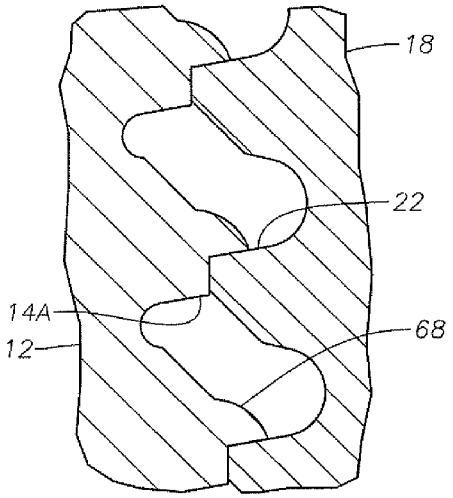
Figure 11:
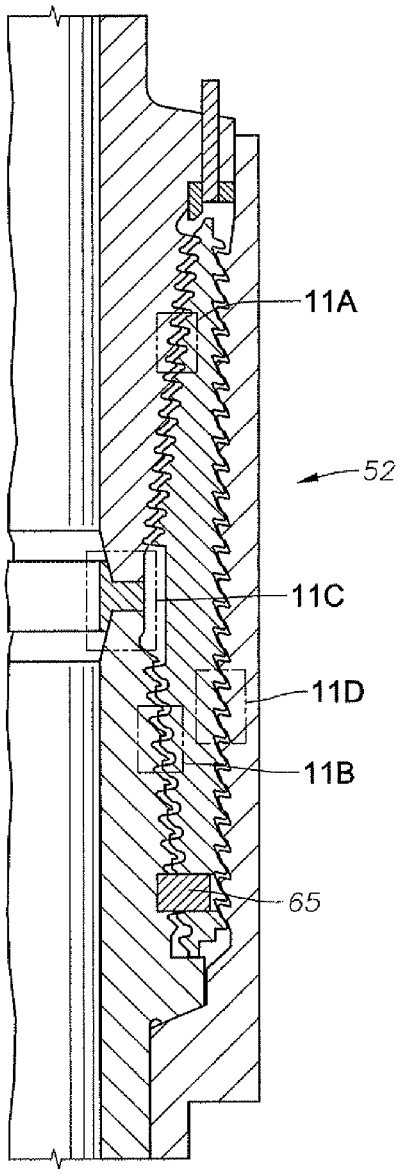
FIG. 11 is a side sectional view of alternate embodiments of a method of assembling a riser in accordance with the present invention.
Figure 12:
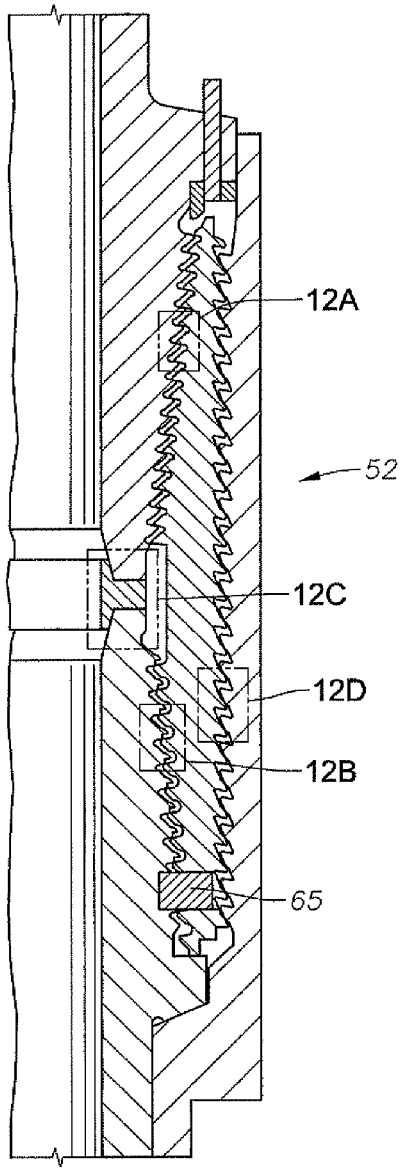
FIG. 12 is a side sectional view of alternate embodiments of a method of assembling a riser in accordance with the present invention.
Figure 11D:
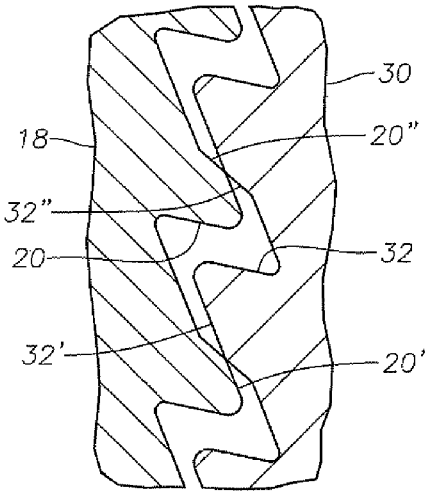
FIGS. 11A-11D are side sectional views of engagement of threads and profiles of the embodiment of FIG. 11.
Figure 11A:
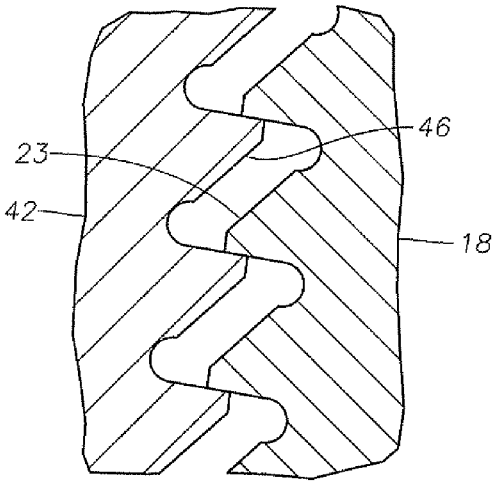
Figure 11C:
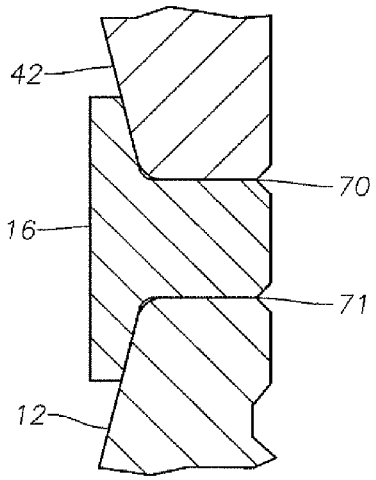
Figure 11B:
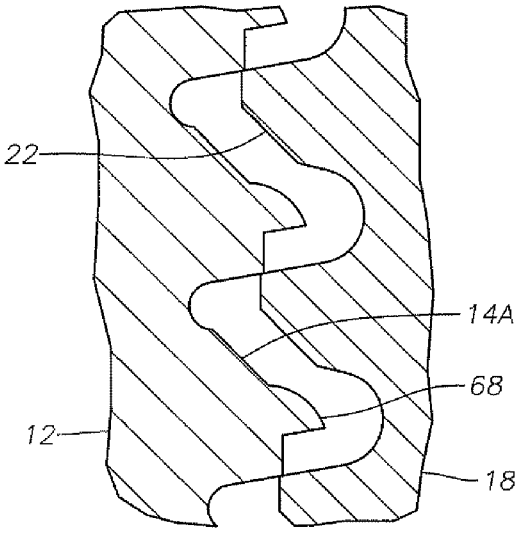
Figure 12D:
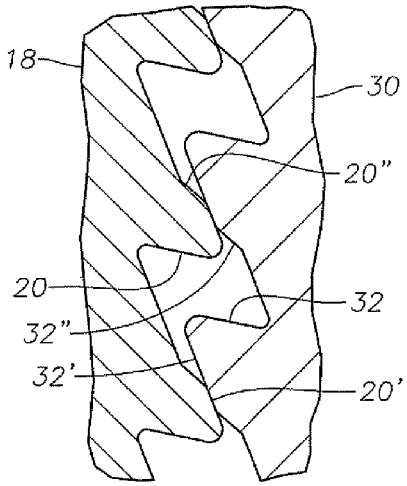
FIGS. 12A-12D are side sectional views of engagement of threads and profiles of the embodiment of FIG. 12.
Figure 12A:
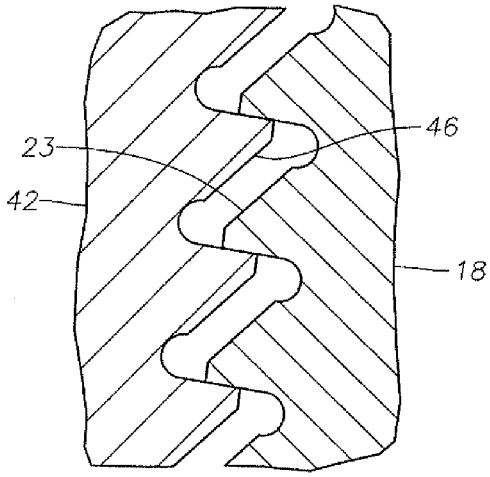
Figure 12C:
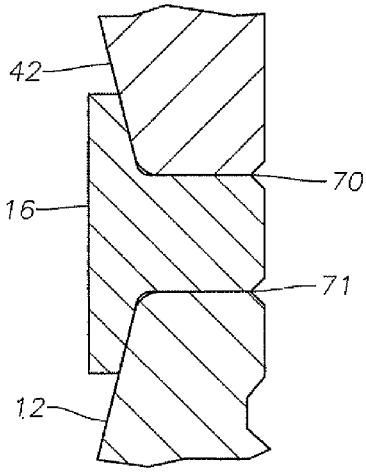
Figure 12B:
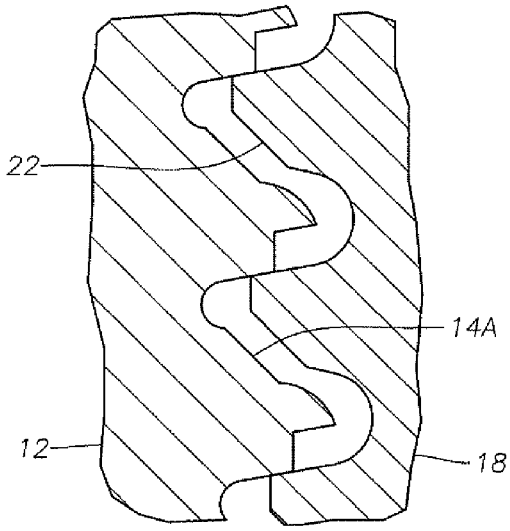

FIG. 10 depicts a configuration of the threaded connection 52 wherein a rotational torque is being applied to the outer sleeve 30 thereby rotating the sleeve 30 with respect to the collet 18. As shown, this produces some overlap between the profiles 23, 46 and increases overlap between threads 14A, 22, as illustrated in FIGS. 10A and 10B, respectively. The gap 66 remains between the nose seal 16 and tubulars 12, 42, as seen in FIG. 10C. As shown in FIG. 10D, rotation of the outer sleeve 30 relative to collet 18 causes inner deep flank 20" to engage inner deep flank 32". As the outer sleeve 30 rotates relative to collet 18 along inner deep flank 20" and inner deep flank 32" the angle of inner deep flank 20" and inner deep flank 32" causes the outer sleeve 30 to rapidly move collet 18 radially inwards. As depicted in FIG. 11, continued rotation of the outer sleeve 30 increases the overlap between threads 23, 46 and changes the contact between threads 14A, 22 so that the threads 22 on the collet 18 engage a load flank on the threads 14A, as shown in FIGS. 11A and 11B, respectively. This draws the tubulars 12, 42 towards the nose seal 16 to form sealing interfaces 70, 71 between the nose seal 16 and tubulars 12, 42 as shown in FIG. 11C. Referring to FIG. 11D, the engagement between threads 20 of collet member 18 and the outer sleeve 30 shifts from inner deep flank 20" and inner deep flank 32" to outer shallow flank 20' and outer shallow flank 32'. Outer shallow flank 20' and outer shallow flank 32' have a shallower angle relative to an axis of the tubular members 12, 42. The shallower angle of outer shallow flank 20' and outer shallow flank 32' causes collet member 18 to contract radially inward at a slower rate but with a greater radial force, while generating an axial preload. With yet additional rotation, a locked configuration is illustrated in FIG. 12. In this embodiment, the overlap of the threads 23, 46 further increases, as shown in FIG. 12A, as well as the overlap of the threads 22 on the load flanks of threads 14A, as shown in FIG. 12B. Sealing interfaces 70, 71 remain between the nose seal 16 and tubulars 12, 42, as shown in FIG. 12C. Referring to FIG. 12D, the threads 20, 32 of the collet member 18, and the outer sleeve 30 will engage along outer shallow flank 20' and outer shallow flank 32', to engage the collet member 18 with the tubulars 12, 42, while applying a strong axial preload force to the tubular members 12, 42.

Figure 13:
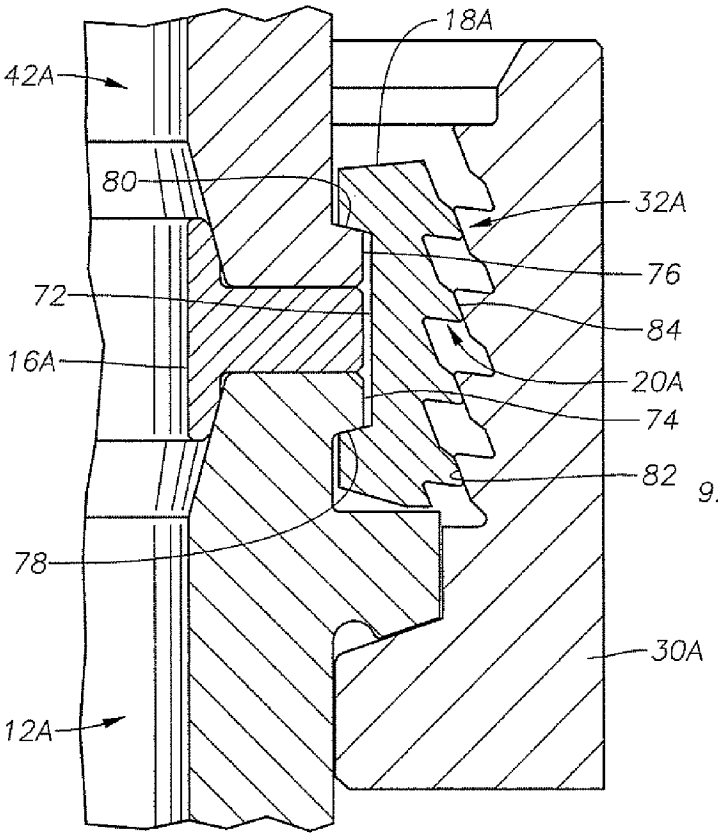
FIG. 13 is a side sectional view of alternate embodiments of connected tubulars.

Shown in a side sectional view in FIG. 13 is an alternate embodiment of coupling tubulars 12A, 42A using a collet 18A and outer sleeve 30A. As shown, the surface of the collet 18A facing the tubulars 12A, 42A includes a channel 72. The upper and lower ends of the tubulars 12A, 42A are provided with corresponding flanges 74, 76 shown set against the nose seal 16A. An end of the channel 72 engages a shoulder 78 defined on the downward facing side of flange 74 and a distal end of the channel 72 engages a shoulder 80 defined on an upward facing side of flange 76. Threads 20A on a side of the collet 18A opposite the channel 72 extend radially outward from the collet 18A with a generally downward facing projection. A generally planar portion 82 of the threads 20A is shown engaging a generally planar portion 84 of threads 32A on the outer sleeve 30A.

Figure 16:
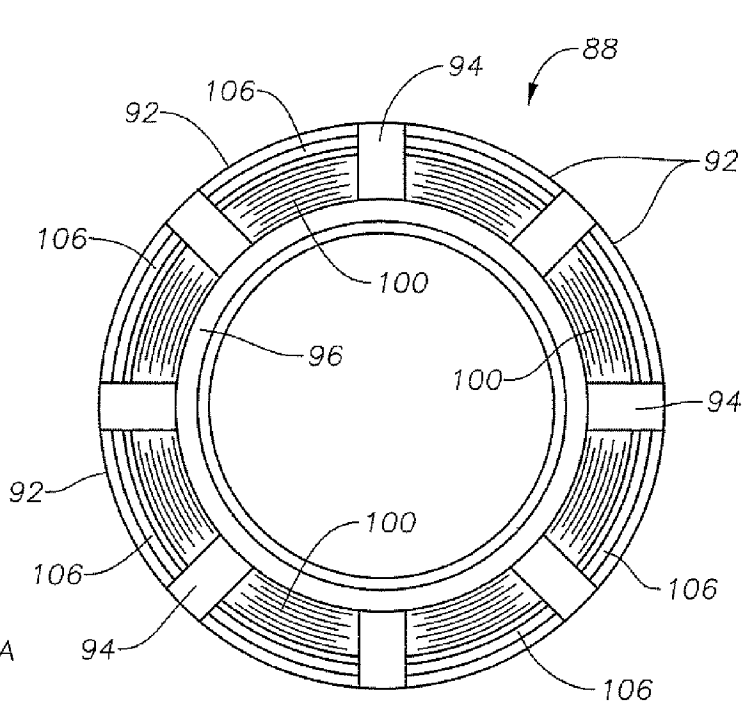
FIG. 16 is a top view of a box end of a first tubular of FIG. 14.
Figure 14:
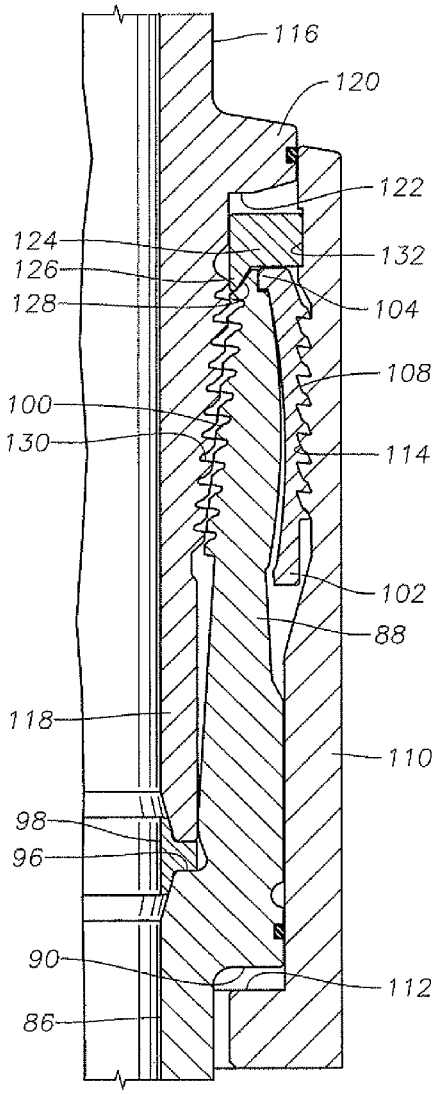
FIGS. 14-15 are side sectional views of alternate embodiments of connected tubulars.

Referring to FIG. 14, an alternate embodiment of coupling tubulars is shown. A first tubular 86 has a box end 88 defining a downward facing shoulder 90 on an outer diameter portion of the first tubular 86. As shown in FIG. 16, the box end 88 includes a plurality of box end fingers 92 having slots 94 interposed between each box end finger 92. Referring to FIG. 14, the box end fingers 92 are axially over the downward facing shoulder 90 and are adjacent an upward facing shoulder 96 formed on the inner diameter of the first tubular 86. In the illustrated embodiment, an optional nose seal 98 is disposed on the upward facing shoulder 96. A person skilled in the art will understand that embodiments without the nose seal 98 are contemplated and included in the disclosed embodiments. Each box end finger 92 has grooves or threads 100 formed on an inner diameter of box end fingers 92. Threads 100 extend from an upper end of the box end fingers 92 toward the upward facing shoulder 96. In the illustrated embodiment, threads 100 extend only partway toward the upward facing shoulder 96. Threads 100 may have an increasing depth along the length of the box end fingers 92 such that threads 100 at an end of the box end fingers 92 have a greater depth than threads 100 proximate to the upward facing shoulder 96.

Figure 15:
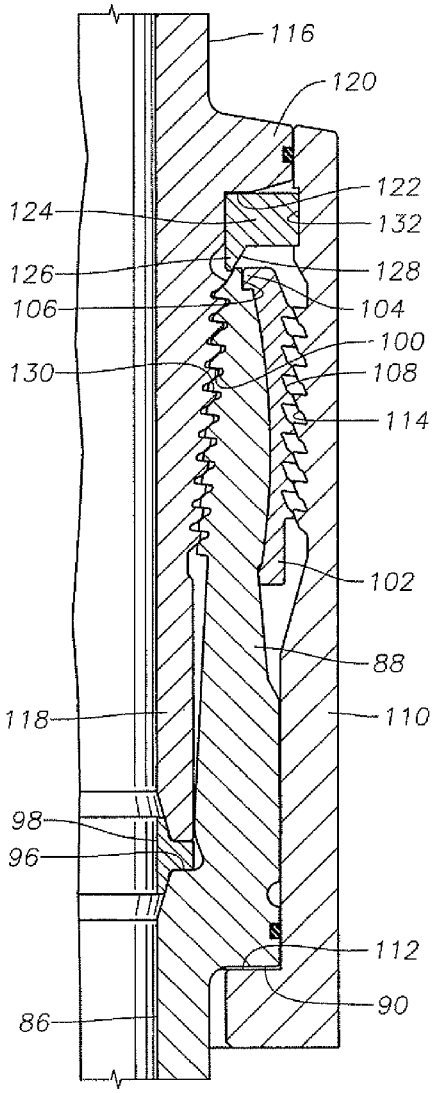

The box end 88 also includes a split collet ring 102 on the outer diameter of the box end 88. As shown, the box end 88 and the box end fingers 92 have a varying width from the downward facing shoulder 90 to an end of the box end 88. The box end 88 has a wider diameter at the downward facing shoulder 90 and a narrower diameter at an end of the box end 88. The split collet ring 102 includes an annular boss 104 formed on an inner diameter of the split collet ring 102. The boss 104 may fit within a pocket 106 on an end of each box end finger 92 of the box end 88, allowing the split collet ring 102 to pivot on the boss 104 in the pocket 106. The box end fingers 92 may have an outer diameter profile, and the split collet ring 102 may have a matching inner diameter profile allowing the split collet ring 102 to contact the box end fingers 92 as illustrated in FIG. 15. The split collet ring 102 also includes the threads 108 formed on an outer diameter of the split collet ring 102 and extending a length of the split collet ring 102 from an end proximate to the boss 104.

Referring to FIG. 14, the box end 88 also includes an outer diameter sleeve 110. The sleeve 110 includes an annular box on a lower end of the sleeve 110 that defines an upward facing shoulder 112. An inner diameter of the sleeve 110 may seal to a lower end of the box end 88 proximate to the downward facing shoulder 90. An upper inner diameter of the sleeve 110 has threads 114 formed thereon. Threads 114 are proximate to and extend an equivalent length to threads 108 of the split collet ring 102. When in an uncoupled position, as shown in FIG. 14, threads 108 of the split collet ring 102 may engage and mate with threads 114 of the sleeve 110. The upward facing shoulder 112 will not be in contact with the downward facing shoulder 90.

A second tubular member 116 has a pin end 118 that inserts into the box end 88 of the first tubular member 86. The pin end 118 has an inner diameter equivalent to the inner diameter of the first tubular member 86 and an outer diameter less than the inner diameter of the box end 88. An end of the pin end 118 will land on the nose seal 98 or, alternatively, the upward facing shoulder 96. An annular ring 120 is formed on an outer diameter of the pin end 118 and defines a downward facing shoulder 122. In the illustrated embodiment an upper inner diameter end of the sleeve 110 axially above threads 114 may seal to the annular ring 120. Grooves or threads 130 are formed on an outer diameter portion of the pin end 118. Threads 130 are proximate to and may engage threads 100 of the box end 88. Threads 130 have an increasing thread depth extending from an end of the pin end 118 toward the annular protrusion 120.

An unlocking ring 124 may be interposed between the pin end 118 and the sleeve 110 axially over the box end 88 and the split collet ring 102. The unlocking ring 124 includes a protrusion 126 with a ramped surface 128 on an end proximate to the outer diameter of the pin end 118. The ramped surface 128 may face the sleeve 110. An opposite end of the unlocking ring 124 will reside within a groove 132 of the sleeve 110. In this manner, axial movement of the sleeve 110 will result in axial movement of the unlocking ring 124. When in the unlocked position of FIG. 14, the protrusion 126 will be interposed between threads 100 and threads 130, and a gap will exist between a top of the unlocking ring 124 and the downward facing shoulder 122.

Referring to FIG. 15, rotation of the sleeve 110 relative to the first tubular member 86 will cause the sleeve 110 to move axially upwards relative to the first tubular member 110 and the split collet ring 102. As a result, threads 114 will move axially upward relative to the split collet ring 102, causing threads 114 to slide along flanks of threads 108 until crests of threads 114 and crests of thread 108 are in contact, creating a radially inward force. The resulting inward radial force causes the split collet ring 102 to first contract against the box end 88, and then move the split collet ring 102 and the box end fingers 92 radially inward to engage threads 100 to threads 130, thereby securing the first tubular member 86 to the second tubular member 116. The box end fingers 92 deflect a greater distance at the ends of the box end fingers 92 than where the box end fingers 92 join the first tubular member 86 above the downward facing shoulder 90. Thus, the increased depth of threads 100, 130 allow for engagement of threads 100, 130 along the entire length of threads 100, 130. A person skilled in the art will understand that threads 100, 108, 114, and 130 may be similar to those described above with respect to FIGS. 1-5 and 9-12.

When the sleeve 110 moves axially upwards the groove 132 may carry the unlocking ring 124 axially upwards until the top of the unlocking ring 124 contacts the downward facing shoulder 122. In alternative embodiments, the unlocking ring 124 may not contact the downward facing shoulder 122. Upwards axial movement of the sleeve 110 is limited by contact of the upward facing shoulder 112 with the downward facing shoulder 90. To unlock the tubular members, the sleeve 110 will be rotated in the opposite direction, causing the sleeve 110 to move axially downwards. The downwards movement will cause the protrusion 126 to insert into the mated threads 100, 130. Continued downwards movement will force the protrusion 126 further between threads 100, 130, releasing threads 100 of the box end fingers 92 from threads 132 of the pin end 118, thereby decoupling the first tubular member 86 from the second tubular member 116.

Accordingly, the disclosed embodiments provide numerous advantages. For example, the disclosed embodiments provide a cost effective rapid make-up connector for tubular members. The connector may be made-up without a wrench or stud tensioning device, placing personnel in close proximity to the drilling slots for shorter periods of time, and decreasing the danger level of performing the task. In addition, the connector may be made up with fewer turns, significantly decreasing the time required to make up the connection. Still further, the connector does not use a significant amount of specialty equipment to make the connection, further reducing overall costs of riser assembly. Still further, the connection uses a specially shaped thread and radially collapsible member to generate a higher axial preload force than current tubular connection systems using rotation and torque to make up.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A subsea riser assembly comprising:

an upper tubular member having an end and an axis;

a lower tubular member having an end, the lower tubular member coaxial with the upper tubular member;

wherein the end of the upper tubular member is proximate to the end of the lower tubular member;

a radially contractible member partially engaged with the end of at least one tubular member while in an initial position;

wherein the radially contractible member has threads on an outer diameter of the radially contractible member;

an outer sleeve having threads on an inner diameter that fully engage the threads on the outer diameter of the radially contractible member in the initial position, the outer sleeve threaded onto the radially contractible member;

wherein rotation of the outer sleeve relative to the radially contractible member in a first direction causes radial displacement between the threads on the inner diameter of the outer sleeve and the threads on the outer diameter of the radially contractible member, thereby partially disengaging the threads on the outer diameter of the radially contractible member from the threads on the inner diameter of the outer sleeve, and moving the radially contractible member inward to a made up position that secures the lower tubular member to the upper tubular member, and wherein the radially contractible member comprises:

a radially contractible collet circumscribing the ends of the upper and lower tubular members;

an upper portion of the collet coaxial with the upper tubular member while in an initial position;

a lower portion of the collet partially engaged with the lower tubular member in the initial position;

the rotation of the outer sleeve and the collet relative to each other causes the collet to fully engage the upper and lower tubular members; and the rotation causes the outer sleeve thread to move from a fully engaged position to a partially engaged position, thereby retaining the collet in the made up position that secures the lower tubular member to the upper tubular member, and wherein, the lower tubular member has grooves formed on an outer diameter portion of the lower tubular member end;

the collet is landed in the initial position on an upward facing collet shoulder formed on the outer diameter portion of the lower tubular member end, the shoulder axially below the lower tubular member end outer diameter grooves;

wherein the collet has lower inner diameter collet grooves formed on an inner diameter lower portion of the collet, and upper inner diameter collet grooves formed on an inner diameter upper portion of the collet;

wherein the lower inner diameter collet grooves partially engage the lower tubular member end outer diameter grooves in the initial position;

the upper tubular member end having outer diameter grooves formed on an outer diameter portion of the upper tubular member end, the upper tubular member end inserted into the collet so that the outer diameter grooves on the lower tubular member end and the outer diameter grooves on the upper tubular member end are adjacent to the inner diameter grooves of the collet in the initial position; and wherein the upper and lower inner diameter grooves of the collet engage the outer diameter grooves of the upper and lower tubular member ends after the rotation moves the collet to the made up position, thereby securing the lower tubular member to the upper tubular member in the made-up position.

2. The subsea riser assembly of claim 1, wherein a gap is formed between the collet and the upward facing collet shoulder in the made-up position.

3. The subsea riser assembly of claim 1, wherein the outer diameter grooves of the lower tubular member end comprises threads, and the lower inner diameter collet grooves comprise threads.

4. The subsea riser assembly of claim 1, wherein the outer diameter grooves of the upper tubular member end comprises threads, and the upper inner diameter collet grooves comprise threads.

5. The subsea riser assembly of claim 1, wherein the lower tubular member end outer diameter grooves include a tip and a planar lower flank partially engaged with the groove of the lower inner diameter collet groove.

6. The subsea riser assembly of claim 1, comprising a nose seal interposed between the ends of the lower and upper tubular members.

7. The subsea riser assembly of claim 1, wherein:

each thread on the outer diameter of the radially contractible member has an outer shallow flank at a shallow angle to the axis;

each thread on the inner diameter of the outer sleeve has an outer shallow flank adapted to mate with the outer shallow flank of the thread on the outer diameter of the radially contractible member; and wherein rotation of the outer sleeve relative to the radially contractible member along the shallow angle generates a radial inward force causing radial contraction of the radially contractible member and an axial preload.

8. The subsea riser assembly of claim 7, wherein the outer shallow flank of the thread on the outer diameter of the radially contractible member has a portion at a greater angle to the axis than the shallow angle to increase the radial contraction of the radially contractible member; and the portion at a greater angle to the axis is spaced away from a crest of the thread.

9. The subsea riser assembly of claim 1, wherein a rotation of less than 360 degrees of the outer sleeve relative to the radially contractible member causes radially outer flanks of the threads on the inner diameter of the outer sleeve and the threads on the outer diameter of the radially contractible member to engage one another to thereby cause the radially contractible member to move to the made-up position.

10. A subsea riser assembly comprising:

a first tubular member having a central bore with an axis and an end with outer diameter grooves formed on an outer diameter portion of the first tubular member end;

a collet landed in an initial position on an upward facing collet shoulder formed on the outer diameter of the first tubular member end, the shoulder axially below the first tubular member end outer diameter grooves;

wherein the collet has lower inner diameter collet grooves formed on an inner diameter lower portion of the collet partially engaged with the outer diameter grooves of the first tubular member in the initial position, upper inner diameter collet grooves formed on an inner diameter upper portion of the collet, and outer diameter collet threads formed on an outer diameter portion of the collet that extend an axial length of the collet;

wherein the collet is radially contractible from the initial position to a made-up position;

an outer annular sleeve having sleeve threads formed on an inner diameter surface of the outer annular sleeve, the sleeve threaded onto the outer diameter collet threads in the initial position;

a second tubular member having a central bore and an axis coaxial with the first tubular member central bore and axis, the second tubular member having an end with outer diameter grooves formed on an outer diameter portion of the second tubular member end inserted into the collet so that the outer diameter grooves on the first tubular member end and the outer diameter grooves on the second tubular member end are adjacent to the lower and upper inner diameter grooves of the collet, respectively, in the initial position;

wherein a rotation of less than 360° of the outer annular sleeve relative to the collet causes radial displacement between the threads on the inner diameter surface of the outer annular sleeve and the outer diameter collet threads to move the collet to the made-up position;

wherein the threads on the outer diameter of the collet are partially engaged with the inner diameter threads of the outer annular sleeve in the made-up position so as to retain the collet in the made-up position; and wherein the upper and lower inner diameter grooves of the collet engage the outer diameter grooves of the first and second tubular member ends, thereby securing the first tubular member to the second tubular member in the made-up position.

11. The subsea riser assembly of claim 10, wherein:

each thread on the outer diameter of the collet has an outer shallow flank at a shallow angle to the axis;

each thread on the inner diameter of the outer annular sleeve has an outer shallow flank adapted to mate with the outer shallow flank of the thread on the outer diameter of the collet; and wherein rotation of the outer annular sleeve relative to the collet along the shallow angle generates a radial inward force causing radial contraction of the collet and an axial preload.

12. The subsea riser assembly of claim 11, wherein the outer shallow flank of the thread on the outer diameter of the collet has a portion at a greater angle to the axis than the shallow angle to increase the radial contraction of the collet; and the portion at a greater angle to the axis is spaced away from a crest of the thread.

13. The subsea riser assembly of claim 10 wherein the outer diameter grooves of the first and second tubular member ends comprise threads, and the upper and lower inner diameter collet grooves comprise threads.

14. A subsea riser assembly comprising:

a tubular member having tubular member threads on an outer surface;

an annular collet circumscribing a portion of the tubular member and comprising:

an inner surface with inner collet threads that selectively engage the tubular member threads on the outer surface of the tubular member, an outer surface having outer collet threads that project radially outward and that each have an outer radial surface that lies in a plane that is oblique to an axis of the tubular member; and an annular outer sleeve that circumscribes the collet and has an inner surface with sleeve threads that have an inner radial surface that is complimentary to and in contact with the outer radial surface of the outer collet threads, so that when the outer sleeve is rotated, the sleeve threads move axially into radial interfering contact with the outer collet threads and urge the collet radially inward and into engaging contact with the tubular member.

15. The subsea riser assembly of claim 14, wherein the tubular member comprises a first tubular member, the riser assembly further comprising a second tubular member coaxial with the first tubular member and having second tubular member threads on an end adjacent the first tubular member, wherein the second tubular member threads are engaged with the inner collet threads thereby coupling the first and second tubular members.

16. The subsea riser assembly of claim 15, further comprising a shoulder on an outer surface of the second tubular member that is in interfering contact with an oppositely facing shoulder on an inner surface of the outer sleeve.

* * * * *